US011788400B2

(12) United States Patent
Dahal et al.

(10) Patent No.: US 11,788,400 B2
(45) Date of Patent: Oct. 17, 2023

(54) METHOD FOR REAL-TIME PAD FORCE ESTIMATION IN ROTARY STEERABLE SYSTEM

(71) Applicant: Halliburton Energy Services, Inc., Houston, TX (US)

(72) Inventors: Jeevan Dahal, Houston, TX (US); John R. Hardin, Houston, TX (US)

(73) Assignee: Halliburton Energy Service, Inc., Houston, TX (US)

( * ) Notice: Subject to any disclaimer, the term of this patent is extended or adjusted under 35 U.S.C. 154(b) by 14 days.

(21) Appl. No.: 17/564,516

(22) Filed: Dec. 29, 2021

(65) Prior Publication Data

US 2023/0203935 A1 Jun. 29, 2023

(51) Int. Cl.
*E21B 44/06* (2006.01)
*E21B 7/06* (2006.01)

(52) U.S. Cl.
CPC ..... *E21B 44/06* (2013.01); *E21B 7/067* (2013.01); *E21B 2200/22* (2020.05)

(58) Field of Classification Search
CPC . E21B 7/06; E21B 7/067; E21B 21/08; E21B 44/06
See application file for complete search history.

(56) References Cited

U.S. PATENT DOCUMENTS 2,796,234 A * 6/1957 Mann ..... E21B 7/062 175/76
4,958,517 A * 9/1990 Maron ..... E21B 47/007 73/152.59
4,972,703 A * 11/1990 Ho ..... E21B 47/007 175/45
7,195,062 B2 3/2007 Cairns et al.
(Continued)

FOREIGN PATENT DOCUMENTS

CN 110720080 A * 1/2020 ..... E21B 10/42
WO 2015054432 A1 4/2015
(Continued)

OTHER PUBLICATIONS

Guan, et al.; "Dynamic behavior analysis of push-the-bit rotary steerable bottom hole assembly"; Journal of Mechanical Science and Technology; Nov. 27, 2018; 12 pgs.
(Continued)

*Primary Examiner* — Jennifer H Gay
(74) *Attorney, Agent, or Firm* — Benjamin Ford; Parker Justiss, P.C.

(57) ABSTRACT

Pad force is one of the major parameters in some drilling systems, such as a RSS, that affect steering decisions during drilling. The disclosure recognizes that the pad force can change during drilling due to, for example, unintentional leaking through a pad seal that has been damaged due to the wear and tear of drilling. With a decrease in the pad force, the steering capability of the drilling tool can be compro-
(Continued)

mised. As such, the disclosure provides a method and system that determines pad force information in real time for controlling drilling. The pad force information can be determined based on sensor data, component data, and drilling data. An estimated pad force is one example of the pad force information that can be calculated and used to direct a drilling operation.

20 Claims, 4 Drawing Sheets

(56) References Cited

U.S. PATENT DOCUMENTS

| | | | | |
|---|---|---|---|---|
| 7,950,473 | B2 * | 5/2011 | Sugiura | E21B 7/062 175/45 |
| 8,118,114 | B2 * | 2/2012 | Sugiura | E21B 7/062 175/25 |
| 8,235,145 | B2 * | 8/2012 | Haugvaldstad | E21B 10/26 175/393 |
| 8,235,146 | B2 * | 8/2012 | Haugvaldstad | F15B 15/08 175/74 |
| 8,376,067 | B2 | 2/2013 | Downton et al. | |
| 8,708,064 | B2 | 4/2014 | Downton et al. | |
| 8,757,294 | B2 * | 6/2014 | Johnson | E21B 7/06 175/266 |
| 8,827,006 | B2 | 9/2014 | Moriarty | |
| 8,869,916 | B2 | 10/2014 | Clausen et al. | |
| 10,066,438 | B2 * | 9/2018 | Kirkhope | E21B 7/062 |
| 10,132,119 | B2 * | 11/2018 | Spencer | E21B 7/04 |
| 10,184,296 | B2 | 1/2019 | Niina et al. | |
| 10,296,678 | B2 * | 5/2019 | Spencer | G06F 30/20 |
| 10,577,866 | B2 * | 3/2020 | Kirkhope | E21B 44/00 |
| 10,683,743 | B2 * | 6/2020 | Benson | E21B 47/09 |
| 10,697,285 | B2 | 6/2020 | May | |
| 10,920,536 | B2 * | 2/2021 | Downton | E21B 43/00 |
| 11,028,645 | B2 | 6/2021 | Hutton | |
| 2008/0234938 | A1 * | 9/2008 | Niemeyer | E21B 49/008 702/11 |
| 2009/0044977 | A1 * | 2/2009 | Johnson | E21B 7/06 702/9 |
| 2009/0166086 | A1 * | 7/2009 | Sugiura | E21B 7/062 175/25 |
| 2009/0205867 | A1 | 8/2009 | Reckmann et al. | |
| 2010/0126770 | A1 * | 5/2010 | Sugiura | E21B 17/1014 175/45 |
| 2011/0139508 | A1 * | 6/2011 | Haugvaldstad | E21B 7/06 175/50 |
| 2011/0139512 | A1 * | 6/2011 | Haugvaldstad | F15B 15/08 60/407 |
| 2015/0142406 | A1 * | 5/2015 | Spencer | E21B 7/04 703/10 |
| 2016/0123118 | A1 * | 5/2016 | Downton | E21B 49/003 703/7 |
| 2016/0160567 | A1 | 6/2016 | Downton | |
| 2016/0348438 | A1 * | 12/2016 | Kirkhope | E21B 7/002 |
| 2016/0362971 | A1 * | 12/2016 | Benson | E21B 47/09 |
| 2017/0058658 | A1 * | 3/2017 | Spencer | E21B 7/04 |
| 2017/0314332 | A1 * | 11/2017 | Kirkhope | E21B 44/00 |
| 2020/0199970 | A1 | 6/2020 | Odegbami | |
| 2021/0363829 | A1 | 11/2021 | Ghimire et al. | |
| 2022/0170359 | A1 * | 6/2022 | Boualleg | G06N 20/20 |
| 2022/0235650 | A1 * | 7/2022 | Zhang | E21B 47/117 |

FOREIGN PATENT DOCUMENTS

| | | | | |
|---|---|---|---|---|
| WO | WO-2018017724 | A1 * | 1/2018 | E21B 10/00 |
| WO | WO-2021126639 | A1 * | 6/2021 | E21B 45/00 |

OTHER PUBLICATIONS

Andrade, et al.; "Rotary steerable systems: mathematical modeling and their case study"; Journal of Petroleum Exploration and Production Technology; May 22, 2021; 19 pgs.

* cited by examiner

METHOD FOR REAL-TIME PAD FORCE ESTIMATION IN ROTARY STEERABLE SYSTEM

TECHNICAL FIELD

This disclosure relates, generally, to directional drilling systems and, more specifically, to steering directional drilling systems such as push-the-bit systems.

BACKGROUND

A wellbore is typically used for the recovery of subterranean resources. Planning a drilling job for a wellbore often includes executing models to predict the performance of a drilling tool during a drilling job. Drilling parameters from the pre-job performance models are then used to steer the drilling tool to the desired location according to the well plan for the drilling job. Various types of drilling tools, also referred to as drilling systems, can be used to drill wellbores. One type of drilling system is a directional drilling system, such as a rotary steerable system (RSS). A RSS is an example of a push-the-bit directional drilling system, wherein pads are used to steer a drill bit in a desired direction. In push-the-bit RSS, the flow at the RSS divides and a fraction of the flow goes to the pad piston, referred to as a bypass. The difference in the pressure between the pad piston and the annulus provides the required pad force for steering the tool. The pad seal may leak due to wear while drilling, causing unintentional leaking through the seal. This leaking would increase the bypass flowrate and decrease the difference in pressure between the pad piston and the annulus, causing a decrease in the pad force. With the decrease in the pad force, the steering capability of the tool would also decrease.

SUMMARY

In one aspect, a method of drilling a wellbore is disclosed. In one example, the method incudes: (1) receiving sensor data from a bottom hole assembly (BHA) in a wellbore during drilling of the wellbore by a drilling tool, (2) obtaining component data of the BHA and drilling data associated with the drilling, and (3) automatically determining, using the sensor data, the component data, and the drilling data, pad force information for the drilling tool during the drilling, wherein the pad force information includes a leak flowrate.

In another aspect, a real-time control and advisory system for drilling is disclosed. In one example, the system comprises one or more processors to perform one or more operations including: (1) receiving one or more of sensor data from a bottom hole assembly (BHA) in a wellbore during drilling of the wellbore by a drilling tool, component data of the BHA, and drilling data associated with the drilling, and (2) determining, during the drilling, pad force information for the drilling tool based on the sensor data, the component data, and the drilling data.

In yet another aspect, the disclosure provides a computer program product having a series of operating instructions stored on a non-transitory computer-readable medium that directs one or more processors when executed thereby to perform operations to direct drilling in a wellbore by a drilling tool. In one example the drilling operations include: (1) obtaining sensor data from a bottom hole assembly (BHA) in a wellbore during the drilling, component data of the BHA, and drilling data associated with the drilling, (2) determining, during the drilling, pad force information for the drilling tool using the sensor data, the component data, and the drilling data, and (3) automatically changing at least one drilling parameter for the drilling based on the pad force information.

BRIEF DESCRIPTION

Reference is now made to the following descriptions taken in conjunction with the accompanying drawings, in which.

DETAILED DESCRIPTION

Figure 1:
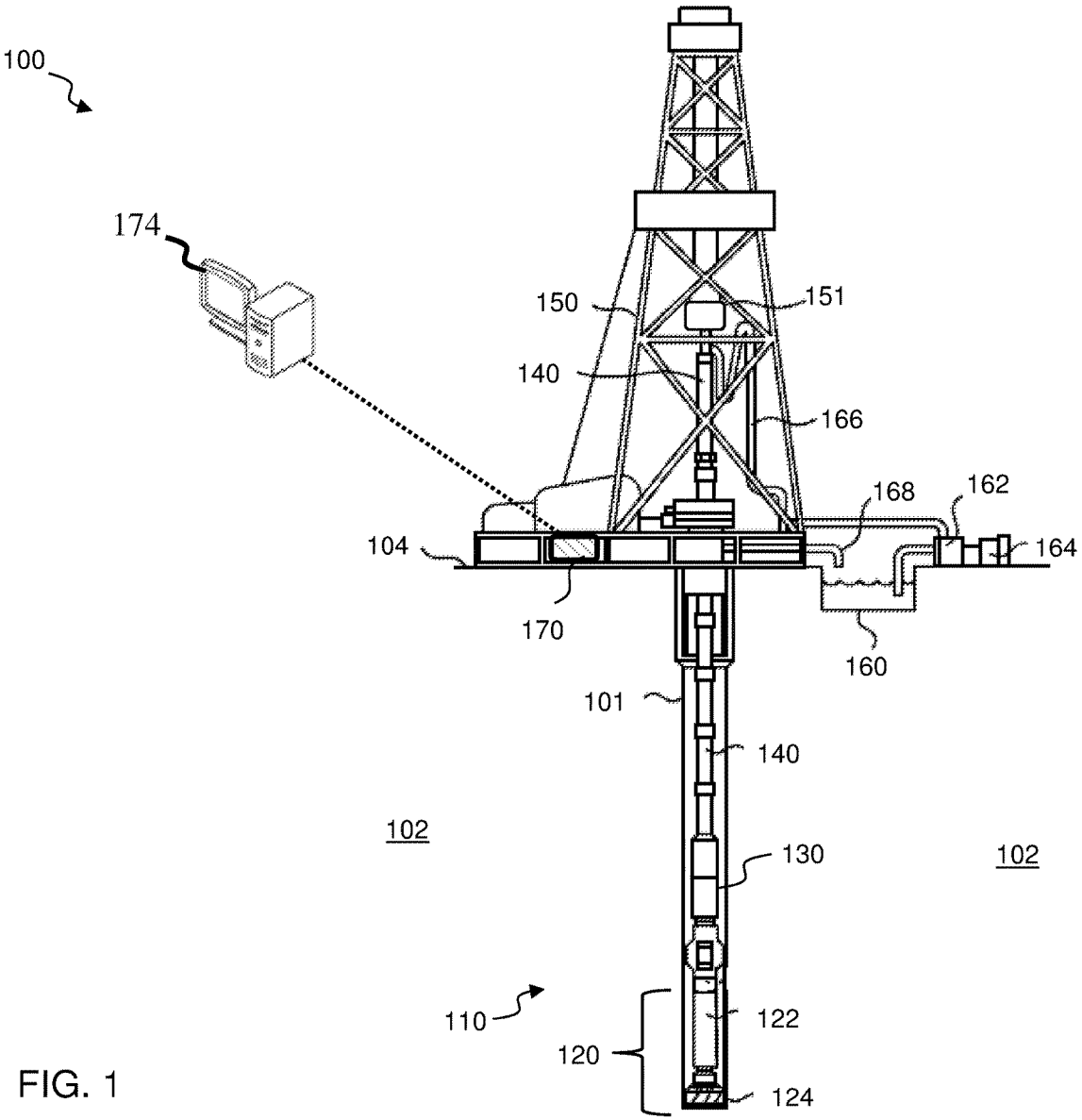
FIG. 1 illustrates a system diagram of an example of a drilling system configured to perform formation drilling to create a wellbore according to the principles of the disclosure.

In a RSS, the pads open and push against the formation to steer the drilling tool in the required direction based on steering input commands, such as Tool face and Duty Cycle. As such, pad force is one of the major parameters in an RSS that affect steering decisions during drilling. While drilling, especially a long formation, the wear on the pad seals may cause fluid leakage that decreases the pad force, adversely affecting the steering performance. For example, a decrease in pad force can cause the RSS to achieve insufficient dogleg for a given Toolface and Duty Cycle steering inputs.

Pad force is dependent upon various drilling parameters and BHA components, such as flowrate, BHA geometry, pad differential pressure, mud weight, etc. Determining the pressure loss at different sections of the BHA in real-time is difficult since most of the pressure loss computation is done offline using computational fluid dynamics (CFD) techniques, which require a high computational cost. Additionally, obtaining sensor data from the BHA for real-time solutions can be difficult due to noise acquired when transmitting the sensor data uphole.

For example, hydraulics models are often used for pad force estimation and the hydraulics models are sensitive to noise in sensor data, such as differential pressure and turbine RPM data, which is transmitted uphole for processing.

Furthermore, pad force is sensitive to the downhole flowrate calculated with turbine flowmeter using turbine RPM and efficiency factor. The downhole flowrate may be different from the surface flowrate depending on the configuration of the BHA. Typically it is difficult to calibrate the turbine flowmeter to accurately predict the downhole flowrate.

To address at least the above concerns, the disclosure provides a process for obtaining pad force information in real-time. Real time as used herein is defined as occurring during drilling by a drill bit when the drill bit is within the wellbore and includes when the drill bit is rotating. The pad force information includes at least one of a leak flowrate, a maximum pad force, an actual pad force, and an expected pad force, and can include each one or any combination thereof. The pad force information can be calculated based on sensor data from downhole sensor measurements, drilling data associated with the drilling, and component data of the BHA that is downhole. The sensor data can include RPM of turbine flowmeter of the BHA and differential pressure at the BHA. The differential pressure used for calculating the pad force information can be measured at the surface or any location of the BHA. A correction factor of the pressure loss to the BHA can be saved and used to calculate the pad force information when using the surface differential pressure. The drilling data can include mud properties associated with the drilling, such as mud weight and viscosity parameters, and operating parameters, such as flow rate and the turbine efficiency factor for the downhole turbine flowmeter. The component data can include geometry information of at least some components of the BHA. For determining the leak flowrate, a process for pad seal leak detection and quantification is disclosed. In addition to real-time processing, the pad force information can be stored for subsequent analysis. For example, the pad force information can be stored in a database for offline analysis that can be used with other wellbores.

The pad force information can be assessed and used to control drilling in real time. The pad force information may be visually presented, such that a user can assess and make real-time drilling decisions to control the drilling. A simplified, user interface can be used for displaying the pad force information in the form of text and charts. Accordingly, the disclosure provides a method and system for users to access the pad force information in real-time through a user-interface. A user can be, for example, a drilling operator or a manager. The pad force information can also be automatically used to make real-time decisions. For example, drilling parameters can be determined based on the pad force information and automatically provided to direct drilling.

The disclosed process can also generate alerts when steering events are identified based on the pad force information, such as the estimated pad force. The steering events can be, for example, plugged nozzle events, sudden decrease of pad force, a gradual decrease in pad force due to pad seal leak, a lost nozzle, and flow control module (FCM) screen plugged. The alerts can be provided to one or more users and can be audible, visual, or another type of sensory alert. For example, an alert can be presented on a display of a controller at a well site.

The disclosed system and method may use a simplified hydraulics model to calculate at least some of the pad force information, such as the average estimated pad force, expected pad force, and maximum pad force. The hydraulics model assumes BHA components behave as an orifice with a certain diameter and flow resistance. The flow resistance parameter for the BHA components, such as all of the BHA components, is calculated using their geometry and pressure loss data obtained from offline analytics. The calculated flow resistance parameters are stored in a lookup table and used during real-time calculations.

The disclosed system and method may also use automatic calibration of downhole turbine flowmeter. As such, accurate downhole flowrate measurements can be obtained for the real-time calculations. Simplified logic may be used for the turbine flowmeter calibration. A surface flowrate can also be used instead of the flowrate from the turbine flowmeter at the BHA. The disclosed system and method may also calculate a moving average of the pad force to eliminate the noise in the instantaneous calculation. The moving average of the parameters is calculated and used as the representative pad force for a given condition to eliminate, or at least reduce, the effect of noise in the pad force calculations. The sensor readings transmitted uphole can also be denoised using some filtering and outlier detection techniques. The filtered data can then be used to calculate the pad force and seal leak.

A pad force information estimator is also disclosed that is configured to perform the processes as disclosed above. The pad force information estimator can be part of a well site controller or computing system associated with a drilling system, such as drilling system 100 of FIG. 1.

FIG. 1 illustrates a drilling system 100 configured to perform formation drilling to create a wellbore 101. The system 100 can be, for example, a logging-while-drilling (LWD) system or a measurement-while-drilling (MWD) system. FIG. 1 depicts an onshore operation. Those skilled in the art will understand that the disclosure is equally well suited for use in offshore operations or onshore operations over a body of water. Additionally, while wellbore 101 is a vertical well one skilled in the art will understand that the disclosure is applicable to other wells that include one or more horizontal sections. The system 100 includes a BHA 110 that includes multiple components including a drilling tool 120 operatively coupled to a tool string 130, which may be moved axially within the wellbore 101. The drilling tool 120 includes a drill controller 122 and a drill bit 124.

The BHA 110 also includes sensors that take measurements during drilling and sends the measurements, or sensor data, uphole for processing by, for example, a pad force information estimator. As an example, the sensors can be a turbine flowmeter and differential pressure sensor of BHA 110. The flowmeter measures the turbine RPM which is linearly related to the downhole flowrate, and differential pressure measures the difference in pressure between the inside of the BHA 110 and the annulus region. The sensor data can be pulsed up in real-time using telemetry as disclosed herein. The pad force information estimator can use the sensor data for real time estimating of pad force information. The pad force information estimator can also receive various other inputs related to the hydraulics of the drilling operation and geometry of components of the BHA 110 for the pad force information estimation.

The system 100 is configured to drive the BHA 110 positioned or otherwise arranged at the bottom of a drill string 140 extended into the earth 102 from a derrick 150 arranged at the surface 104. The system 100 includes a top drive 151 that is used to rotate the drill string 140 at the surface 104, which then rotates the drill bit 124 into the earth to thereby create the wellbore 101. Operation of the top drive 151 is controlled by a top drive controller. The system 100 can also include a kelly and a traveling block that is used to lower and raise the kelly and drill string 140.

Fluid or "drilling mud" from a mud tank 160 is pumped downhole using a mud pump 162 powered by an adjacent power source, such as a prime mover or motor 164. The drilling mud is pumped from mud tank 160, through a stand pipe 166, which feeds the drilling mud into drill string 140 and conveys the same to the drill bit 124. The drilling mud exits one or more nozzles arranged in the drill bit 124 and in the process cools the drill bit 124. After exiting the drill bit 124, the mud circulates back to the surface 104 via the annulus defined between the wellbore 101 and the drill string 140, and in the process, returns drill cuttings and debris to the surface 104. The cuttings and mud mixture are passed through a flow line 168 and are processed such that a cleaned mud is returned down hole through the stand pipe 166 once again.

The drill controller 122 provides directional control of the drill bit 124 as it advances into the earth 102. The drilling tool 120 can be a RSS, such as a push-the-bit drilling tool. As such, the drill controller 122 can steer drill bit 124 by controlling the operation of pads (not shown in FIG. 1) to push off the sidewalls of the wellbore 101. The drill controller 122 can control the operation of the pads based on input commands for steering the drill bit, such as Tool face and Duty cycle of the pads. The drill controller 122 can automatically change the duty cycle in real time based on pad force information determined in real-time. The pad force information and resulting input commands can be determined uphole and transmitted downhole to the drill controller 122. A drilling controller of a control and advisory system located at least partially at the surface of the wellbore 101 can transmit the commands from the surface to the drill controller 122. The control and advisory system can be implemented, for example, on well site controller 170 or computing system 174.

The tool string 130 can be semi-permanently mounted with various components including measurement tools (not shown) such as, but not limited to, MWD and LWD tools, that may be configured to take downhole measurements of drilling conditions and geological formation of the earth 102. The measurement tools can include sensors, such as magnetometers, accelerometers, gyroscope, etc.

The system 100 also includes a well site controller 170, and a computing system 174, which can be communicatively coupled to well site controller 170. Well site controller 170 includes a processor and a memory and is configured to direct operation of the system 100.

Well site controller 170 or computing system 174, can be utilized to communicate with the BHA 110, such as sending or receiving drilling sensor data, instructions, and other information, including but not limited to sending steering instructions to the drilling tool 120. A communication channel may be established by using, for example, electrical signals, mud pulse telemetry, or another type of telemetry between components of the BHA 110 and the well site controller 170.

The well site controller 170, or a separate computing device such as computing system 174 or a processor located with the BHA 110 can be configured to perform one or more of the functions of a pad force information estimator as disclosed herein. For example, the well site controller 170, the computing system 174, or a combination thereof can be configured to determine pad force information in real time that can be used for making drilling decisions in real-time to operate the drilling tool 120. The well site controller 170 and the computing system 174 can include one or more memories for data storage and one or more processors for executing operating instructions, such as determining the pad force information in real time. At least one of the one or more memories of the well site controller 170 or the computing system 174 can be used to store the pad force information for offline analysis. At least one of the processors of the well site controller 170 or the computing system 174 can be used for executing the offline analysis.

Computing system 174 can be proximate well site controller 170 or be distant, such as in a cloud environment, a data center, a lab, or a corporate office. Computing system 174 can be a laptop, smartphone, personal digital assistant (PDA), server, desktop computer, cloud computing system, other computing systems, or a combination thereof, that are operable to perform the processes and methods described herein. Well site operators, engineers, and other personnel can send and receive data, instructions, measurements, and other information by various conventional means with computing system 174 or well site controller 170. A pad force information estimator can be part of a drilling advisory system that is instantiated on, for example, the well site controller 170, the computing system 174, or distributed across both.

Figure 2:
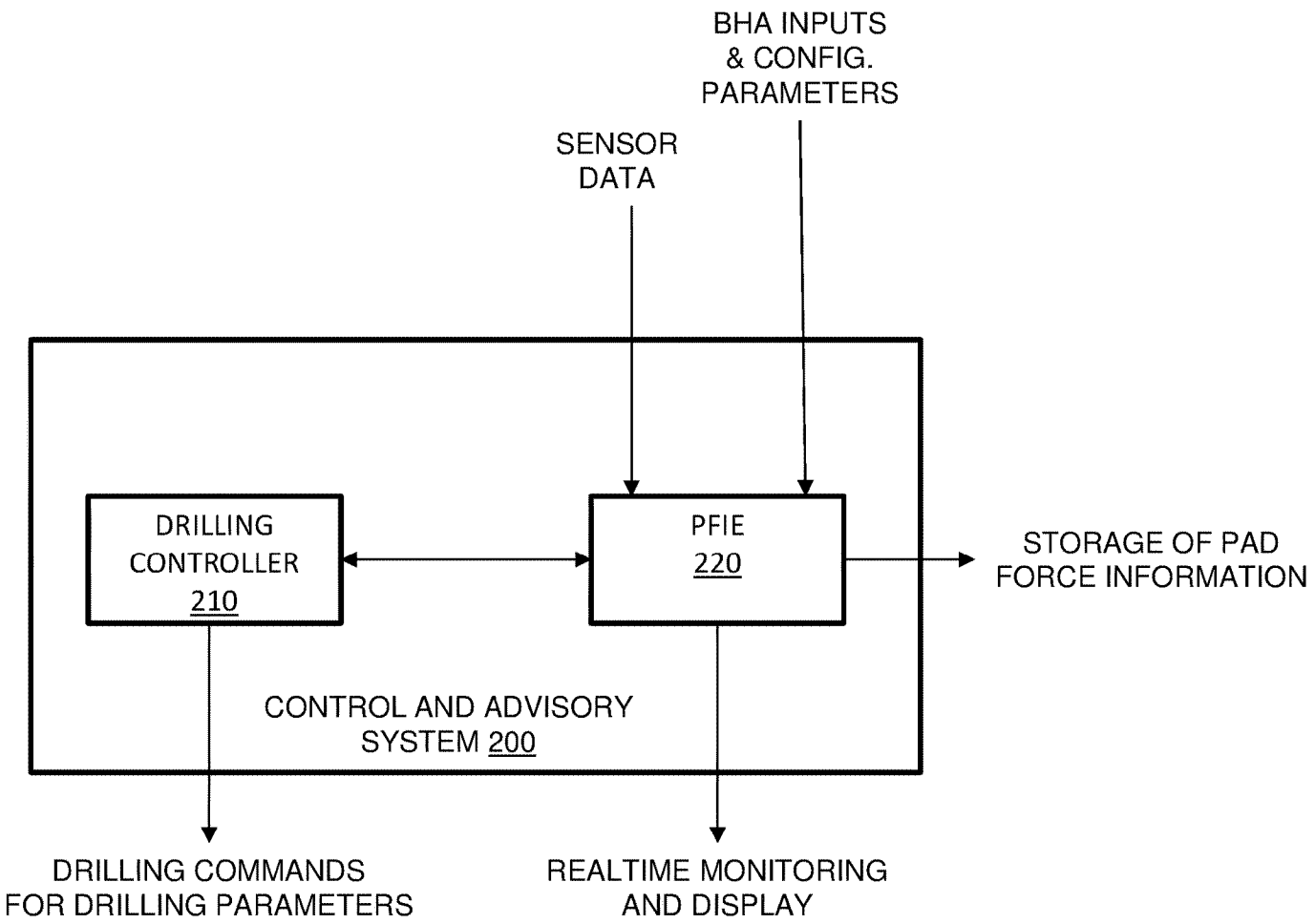
FIG. 2 illustrates a block diagram of an example of a control and advisory system constructed according to the principles of the disclosure.

FIG. 2 illustrates a block diagram of an example of a control and advisory system 200 constructed according to the principles of the disclosure. The control and advisory system 200 is typically implemented on one or more computing device that is located at the surface of a wellbore. For example, the control and advisory system 200 can be part of well system controller, such as well site controller 170 of FIG. 1. The control and advisory system 200 is configured to present pad force information that can be used to make real-time drilling decisions. The control and advisory system 200 can also automatically initiate drilling commands in real-time based on the pad force information. The control and advisory system 200 includes a drilling controller 210 and a pad force information estimator 220. The control and advisory system 200 can include one or more processors to perform the operations of the drilling controller 210 and the pad force information estimator 220. The control and advisory system 200 can also include a communications interface for receiving and sending data and data storage, such as one or more memory, for storing data and operating instructions to direct operation of at least one of the drilling controller 210 and the pad force information estimator 220.

The drilling controller 210 is configured to direct a drilling operation. As such, the drilling controller 210 can issue drilling commands to change drilling parameters for the drilling operation. The drilling controller 210, for example, can send commands to a system located at the surface to change drilling parameters of a drilling operation, send commands downhole to change drilling parameters, and can send commands to a surface system and a downhole system to change drilling parameters. For example, the drilling controller 210 can send a command to a mud pump to change the flow rate of mud being pumped into the wellbore. Additionally, the drilling controller 210 can send steering inputs, such as a duty cycle change, downhole to a drill controller to change operation of pads to steer a drill bit. The drilling controller 210 can issue drilling commands based on the pad force information that is determined in real-time by the pad force information estimator 220.

The pad force information estimator 220 is configured to determine pad force information for a drilling tool in real-time. The drilling controller 210 can determine the pad force information based on sensor data from a BHA in a wellbore during drilling of the wellbore by a drilling tool, component data of the BHA, and drilling data associated with the drilling. The various types of data can be provided to and received by the control and advisory system 200. The control and advisory system 200 can receive, such as via the communications interface, the sensor data from downhole sensors during drilling via a telemetry system in the wellbore. The pad force information estimator 220 can also implemented on one or more computing device that includes a communications interface for receiving and sending data, one or more processors, and one or more memory for storing data and operating instructions to direct operation of the one or more processors. The sensor data can be turbine flow RPM and differential pressure at the BHA. The drilling data can be mud properties from the drilling operation, such as mud density. The component data can be size and geometry data of the different components of the BHA. For example, the component data can be the size of all available BHA components that contribute to the pressure loss for calculating pad differential pressure from differential pressure input. For example, the size of the tool restrictor, drill controller, bit, bit total flow area (TFA), hole size, and other components may be present in the BHA and may contribute to calculating pad differential pressure from measured differential pressure. In that case, their size information is input for determining at least a portion of the pad force information. One or more of the different types of data can be received by manual input or automatically received via a communications interface. For example, the inputs may be manually fed by a user or automatically acquired by connecting and querying a database.

The pad force information estimator 220 can output the pad force information as a visual representation for review and monitoring by a user. For example, the pad force information can be displayed on a screen in the form of numbers and graphs for a user. One or more computing device in which at least a portion of the control and advisory system 200 is implemented can include a screen for the displaying. A web interface for displaying the pad force information can be used, which displays the trend of the data in the form of a chart for the last few hundred feet of drilling. The web interface can also displays alerts when they are generated by the pad force information estimator 220 when a steering event is detected.

The user can initiate a change in drilling parameters based on the output of the pad force information estimator 220, such as the displayed information. The pad force information estimator 220 can also send the pad force information to a database for recording the real-time data for offline analysis. The pad force information estimator 220 can be configured to determine drilling parameters based on the pad force information and send the drilling parameters to the drilling controller 210 for implementation. The drilling controller 210 can also receive the pad force information and determine drilling parameters based thereon. Accordingly, the logic for determining drilling parameters based on the pad force information can be located in the drilling controller 210, the pad force information estimator 220, or distributed in both the drilling controller 210 and pad force information estimator 220. The pad force information estimator 220 can be configured to operate according to one or more algorithms corresponding to the method 300.

Figure 3A:
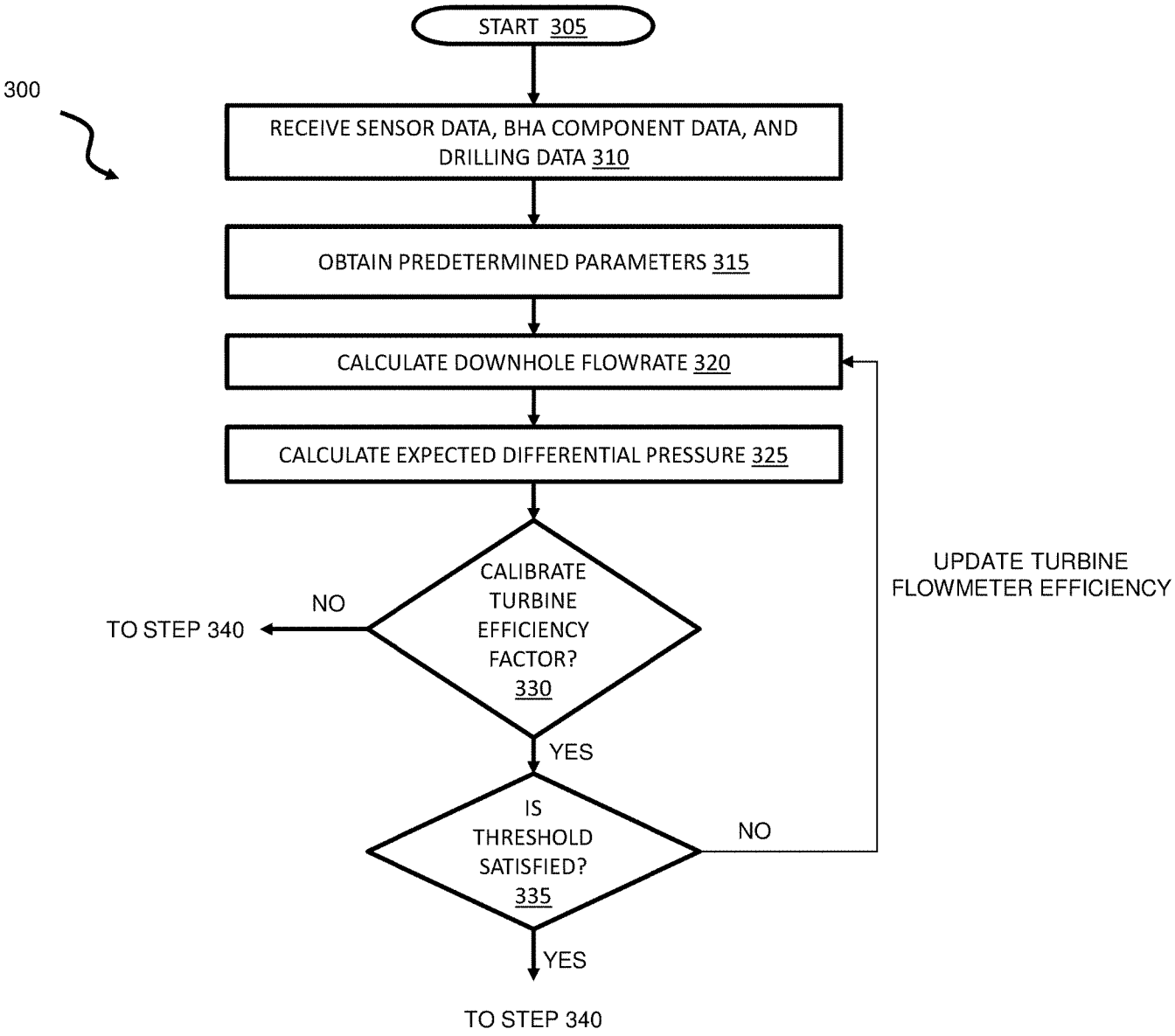
FIGS. 3A and 3B illustrate a flow diagram of an example of a method of drilling a wellbore carried out according to the principles of the disclosure.
Figure 3B:
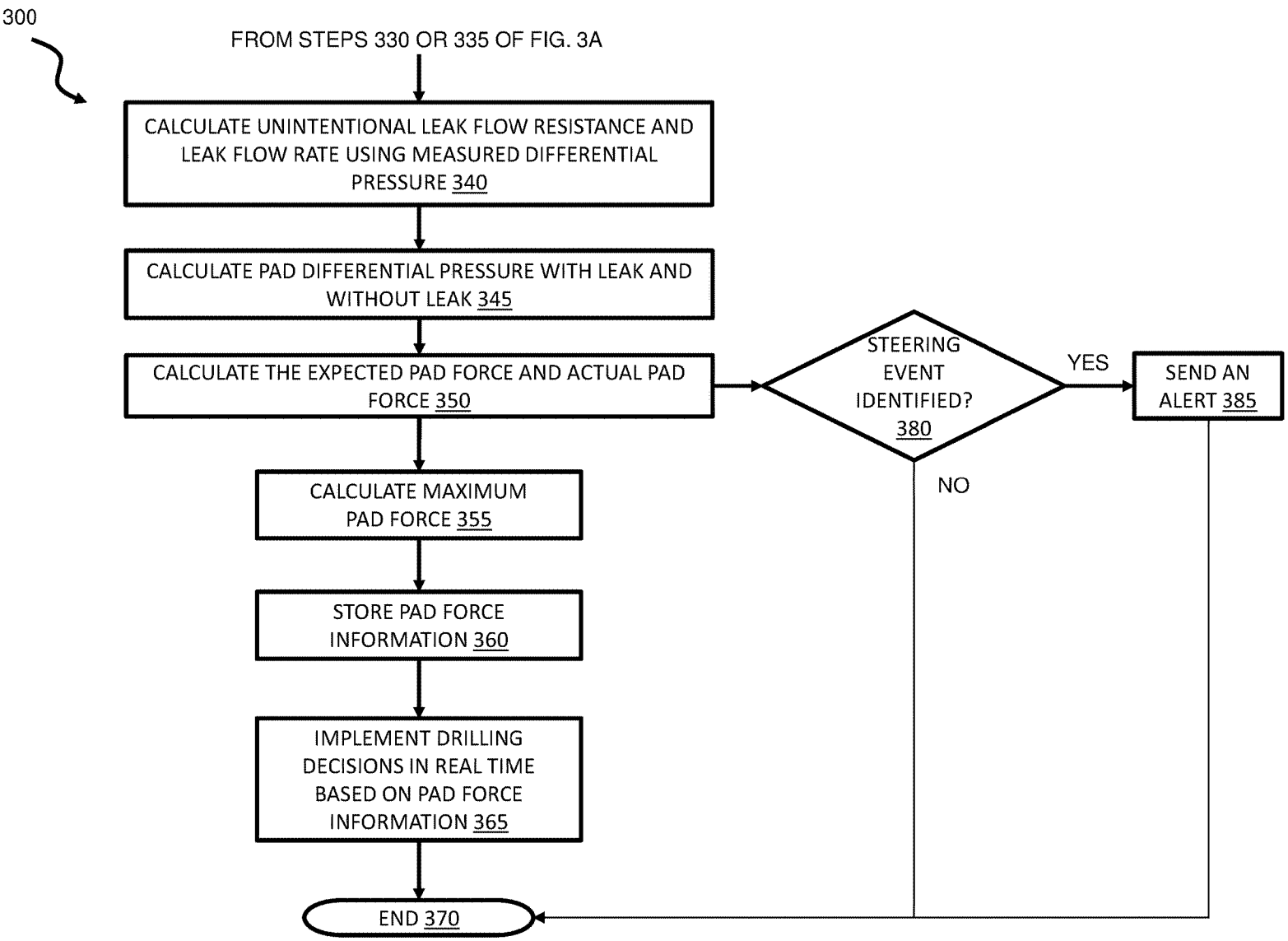

FIGS. 3A and 3B illustrate a flow diagram of an example of a method 300 of drilling a wellbore carried out according to the principles of the disclosure. A computing device can perform at least a portion of method 300 according to algorithms that correspond to one or more of the steps of method 300. The algorithms can be represented as a series of operating instructions that direct the operation of one or more processors of the computing device when executed thereby. At least a portion of the method 300 can be carried out by a control and advisory system, such as disclosed in FIG. 2. Additionally, at least a portion of the method 300 can be carried out in real-time. The method 300 can be used with a RSS of a BHA in a wellbore. The method 300 begins in step 305.

In step 310, sensor data, BHA component data, and drilling data is received. The sensor data is from downhole sensors of the BHA that at least provide differential pressure and turbine flowmeter RPM. The sensor data can be received via a telemetry system of the BHA. The BHA component data and the drilling data can be received via manual input or via a query of a database. The BHA component data includes geometry information of components that contribute to the differential pressure. The drilling data includes at least the mud weight.

Predetermined parameters are obtained in step 315. The predetermined parameters include, for example, flow resistance parameters for the BHA components, linear fit parameters for turbine flowrate, pad force calculations, and pressure limits of the pad seal. The flow resistance parameters can be determined offline using CFD models since the BHA components are known before the drilling operation. The flow resistance parameters can be stored in a database, such as in a lookup table, for querying when needed. For example, pressure drop at each BHA component can be modeled using an orifice equation that includes the pressure loss at the component, the density of the mud (or fluid), the flowrate of the mud, the area of the component, and the flow coefficient of the component. The pressure loss at each component of the BHA can be calculated offline using CFD techniques for different configurations. Using the pressure drop calculated, the dimensionless flow coefficient of each of the BHA components can then be calculated using the orifice equation and stored in a look-up table. An example configuration of the BHA components may be flex component, tool restrictor, in-bit sensor system, drill bit, drill nozzle port, manifold, steering head, and flow control module. For all or some of the larger BHA sections, additional correction to the dimensionless flow coefficient can be done by making correction for the change in flowrate and mud weight. Non-Newtonian hydraulics pressure loss model in a pipe can be used to derive a relationship between the dimensionless flow resistance, flowrate, and mud weight. For this, additional input of the reference flowrate, reference mud weight, and viscosity parameters is required. Reference values refers to the parameter value at which the dimensionless flow coefficients are calculated offline.

The linear fit parameters can also be determined offline and similarly stored in a database to be queried when needed. The linear fit parameters include slope and intercept values and can be used for determining the downhole flowrate and pad force using a linear model. The linear fit parameters for pad force can be determined offline via CFD analysis used to calculate the pad force using pad differential pressure. The linear fit parameters can be stored in, for example, a look-up table.

Additional offline calculations can also be performed and later used by the method 300. The disclosure recognizes that pad force is linearly related to the pad differential pressure. However, the method 300 receives the differential pressure at the location of the sensor in the BHA. As such, a relationship between the input differential pressure and pad differential pressure can be developed offline and used to determine pad force using the differential pressure data. The relationship can be based on hydraulics modeling, the orifice equation noted above, and flow equations.

In step 320, the downhole flowrate is calculated. The downhole flowrate can be calculated in real-time during the drilling operation using the turbine efficiency factor, the turbine flowmeter RPM and the linear fit parameters. The linear fit parameters can be queried from the lookup table.

The expected differential pressure is calculated in step 325. The expected differential pressure is the differential pressure when there is no pad seal leak. In case of no leak condition, the expected differential pressure should be close to the measured differential pressure.

In step 330, a determination is made if calibration of the turbine efficiency factor is needed. Calibration of the turbine efficiency factor can be needed during the first run of the method 300 or in response to a user command for calibration. The disclosure recognizes that pad force is sensitive to the flowrate. As such, calibration of the turbine flowmeter is beneficial for accurate calculations.

If not needed, the method 300 continues to step 340 that is described below. If a determination is made that calibration is needed, the method 300 continues to step 335 where a determination is made if a user threshold is satisfied. For example, when the method 300 is run for the first time, the expected and measured differential pressure are compared to see if the calibration of turbine efficiency factor is accurate. If the difference between them is more than a threshold value, a suitable efficiency factor value is suggested. The threshold value can be set by the user based on, for example, historical data, and has a default value. The comparison equation can be if the absolute value of the average expected differential pressure minus the average measured differential pressure is less than the user set threshold.

If the threshold is satisfied, the method continues to step 340. If the threshold is not satisfied, the turbine flowmeter efficiency is updated.

A lower and upper bound can be used for calibrating the turbine efficiency factor. For example, the lower and upper bound for the turbine efficiency factor can be set to 0.9 to 1.1 respectively. The turbine flowrate and expected differential pressure are calculated in a loop for step increase in turbine efficiency factor of 0.01 from the lower bounds and calibration criteria is checked for each step. The efficiency that meets the criteria is stored and suggested to the user. The user can change the input of the efficiency factor to meet the suggested value. For the entire run, the efficiency can now be kept constant. The turbine efficiency factor can also be automatically changed based on the suggested value.

The calibration logic can execute at the beginning of the bit run when an unintentional leak from the pad seal is not expected. Additionally, as noted above in step 330, in certain conditions the turbine efficiency factor may need to be calibrated by the user at any point in drilling during the drilling operation. In that case, the user can give the command to run the calibration routine.

In step 340, unintentional leak flow resistance and leak flow rate are calculated using measured differential pressure. The leak flowrate is the difference between a bypass flowrate and the nozzle flowrate. Input parameters can also be used with the measured differential pressure to determine the unintentional flow resistance and leak flow rate. The input parameters are the downhole flowrate calculated after turbine calibration, mud weight, and flow resistance of the BHA components in the flow path. In the case of a leak, the bypass flowrate will increase because the unintentional leak from the pad seal reduces the flow resistance of the bypass. The increased bypass flowrate will increase the pressure loss in the bypass flow path to the pads, resulting in a reduction in pad differential pressure and pad force. The additional bypass flow will also cause a decrease in the differential pressure because less flow rate is directed to the tool restrictor and bit nozzles. Hydraulics equations can be used to calculate this unintentional leak using the inputs.

In step 345, pad differential pressure with leak and without leak are calculated. The expected pad differential pressure (without leak) can be calculated using the downhole flowrate and flow resistance at each BHA component using hydraulics modeling.

The expected pad force and actual pad force are calculated in step 350. The expected pad force can be calculated using the pad differential pressure at no leak condition that was determined in step 345. The actual pad force during drilling can be determined based on a relationship between the pad differential pressure and leak flowrate for the condition of unintentional leak through the pad seal. The leak flowrate can be calculated by calculating the difference in bypass and nozzle flowrate.

The maximum pad force is calculated in step 355. This parameter can be obtained offline and stored in the lookup table. The predetermined pad seal pressure limit value gives the maximum pad force that can be obtained from a given pad seal configuration.

In step 360, the pad force information is stored. The pad force information, which at least includes the actual, expected, and maximum pad force and the leak flowrate, can be stored for offline analysis.

In step 365, drilling decisions based on the pad force information are implemented in real-time. The drilling decisions can be automatically initiated or input manually. The drilling decisions can, for example, automatically change steering inputs, mud weight, flow rate, or a combination thereof. In step 370, the method 300 ends. Additional steering parameters like dogleg severity, build rate, and turn rate may also be used as inputs for making real-time decisions.

Returning to step 350, the method 300 also proceeds to step 380 where a determination is made if a steering event is identified. Various steering events can be identified based on at least some of the pad force information that has been calculated by the method 300. In some examples, machine learning can be used to classify features of various steering events, wherein a model is trained using historical data the various events. Examples of different steering events that can be identified are provided below. When identified, an alert can be generated in step 385.

A plugged nozzle is one example of a steering event. When there is a large difference between the measured differential pressure and expected differential pressure, an additional test can be done to check if it meets the plugged nozzle condition: If the Average Differential Pressure>>Expected Differential Pressure. A simulation is run by changing nozzle diameter input to calculate the differential pressure that is expected when the nozzle is plugged. If the measured differential pressure is in the range of the plugged nozzle's expected differential pressure, a plugged nozzle alert is produced in step 385.

Another steering event is a gradual decrease in pad force due to pad seal leak and sudden loss of pad seal. Logic can be used to detect the gradual decrease in pad force and sudden decrease in the pad force. The sudden decrease in the pad force may be detected using a supervised learning algorithm by training the model using the historical data for similar events. A gradual decrease in the pad force is expected due to the pad seal leak. However, the sudden decrease in the pad force may happen due to the sudden loss of pad seal. The distinction between the gradual decrease in the pad force from the sudden loss of pad seal can be made by doing statistical analysis in the pad force data. A linear regression model is fit to the pad force data for the drilling run to estimate the natural trend of the decrease in the pad force. A linear regression model may consist of several independent variables like differential pressure, mud weight, flowrate, and etc. as input and the pad force as the output. Alternatively, feature engineering methods like principle component analysis or correlation checks may be applied to find the best combination of these input parameters as the independent variables that would best describe a model.

In the linear regression model, there is a linear relationship between the coefficients, $\beta$, and the independent variables, x. The coefficients or weights, $\beta$ can be obtained from a supervised learning algorithm like simple multivariate linear regression, Decision tree, Random forest, or Support Vector regression with or without the regularization. These supervised learning algorithms solve an optimization problem to get a best value of the coefficients that will minimize the cost function. The cost function may be root mean square error (RMSE), mean square error (MSE) or any other function that gives an error between the model prediction and the actual data.

Once the model is obtained, statistical analysis can be performed to find the confidence interval that would contain most of the data observed. This confidence interval will determine if the future estimated pad force is within the limits of natural trend or is outside of that trend. If it is outside of the confidence interval and lower than the estimated pad force, than it can be considered as a sudden decrease and consequently an alert can be produced in step 385.

Lost nozzle is yet another example of a steering event. In the event of lost nozzle, measured differential pressure becomes lower than expected differential pressure. However, logic is set up to differentiate the lost nozzle condition from the pad seal leak and sudden loss of pad seal. The lost nozzle condition may be simulated to find out the differential pressure at the lost nozzle condition by changing the diameter of the flow path to the nozzle from nozzle diameter to the port diameter. If the differential pressure measurement is in the range of this lost nozzle differential pressure, an alert is produced to identify the lost nozzle condition in step 385.

Another example of a steering condition is FCM screen being plugged. For this condition, the measured differential pressure is higher than the expected differential pressure which is not consistent with the expected differential pressure at the plugged nozzle condition. Additionally, Dogleg Severity (DLS) is checked to see if the DLS decreased. In that case, an alert is produced in step 385 that may be due to FCM Screen being plugged.

If no steering event is identified in step 380, the method 300 continues to step 370 and ends. The method 300 also continues to step 370 after step 385.

The disclosed features of real-time estimation of pad force can enable operators to be able to gain early knowledge of the decrease in pad force and any unintentional leak happening downhole. This information can be used by an operator or directional driller to make an effective decision like replacing the tool or tweaking some operating parameters to achieve a required dogleg.

The disclosed features can also provide real-time advisory and alerts for various events related to the pad force and steering which can be used as an assist to directional driller and enhance directional drilling process.

A framework for doing offline data analytics related to steering and pad force is also provided by storing the real-time calculated data in a database. The calculated pad force information can also be incorporated into or used with a drilling controller for making dynamic changes to drilling parameters.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Aspects disclosed herein include:

A. A method of drilling a wellbore, including: (1) receiving sensor data from a bottom hole assembly (BHA) in a wellbore during drilling of the wellbore by a drilling tool, (2) obtaining component data of the BHA and drilling data associated with the drilling, and (3) automatically determining, using the sensor data, the component data, and the drilling data, pad force information for the drilling tool during the drilling, wherein the pad force information includes a leak flowrate.

B. A real-time control and advisory system for drilling, comprising one or more processors to perform one or more operations including: (1) receiving one or more of sensor data from a bottom hole assembly (BHA) in a wellbore during drilling of the wellbore by a drilling tool, component data of the BHA, and drilling data associated with the drilling, and (2) determining, during the drilling, pad force information for the drilling tool based on the sensor data, the component data, and the drilling data.

C. A computer program product having a series of operating instructions stored on a non-transitory computer-readable medium that directs one or more processors when executed thereby to perform operations to direct drilling in a wellbore by a drilling tool, the operations including:

(1) obtaining sensor data from a bottom hole assembly (BHA) in a wellbore during the drilling, component data of the BHA, and drilling data associated with the drilling, (2) determining, during the drilling, pad force information for the drilling tool using the sensor data, the component data, and the drilling data, and (3) automatically changing at least one drilling parameter for the drilling based on the pad force information.

Each of the disclosed aspects A, B, and C can have one or more of the following additional elements in combination. Element 1: further comprising operating the drilling tool based on the pad force information. Element 2: wherein the pad force information further includes at least one of a maximum pad force, an average pad force, and an expected pad force. Element 3: further comprising storing the pad force information. Element 4: further comprising visually displaying the pad force information. Element 5: wherein the sensor data includes RPM of turbine flowmeter of BHA and differential pressure at the BHA. Element 6: further comprising automatically calibrating a turbine efficiency factor of the turbine flowmeter. Element 7: further comprising automatically identifying steering events related to the pad force information. Element 8: further comprising automatically generating alerts based on the steering events that are identified. Element 9: wherein the automatically identifying uses machine learning to classify the steering events. Element 10: wherein the component data includes geometry information of at least some components of the BHA. Element 11: wherein the drilling data includes mud properties associated with the drilling. Element 12: further comprising automatically changing drilling parameters based on the pad force information. Element 13: wherein the one or more operations further include automatically changing drilling parameters for the drilling tool based on the pad force information. Element 14: wherein the one or more operations further include providing a visual output of the pad force information. Element 15: wherein the one or more operations further include automatically calibrating a turbine efficiency factor of a turbine flowmeter of the BHA. Element 16: wherein the one or more operations further include automatically identifying steering events related to the pad force information and automatically generating an alert when at least one steering event is identified. Element 17: wherein the at least one drilling parameter is a steering input for the drilling tool.

What is claimed is:

1. A method of operating a drilling tool in a wellbore, comprising:

receiving sensor data from a bottom hole assembly (BHA) in a wellbore during drilling of the wellbore by a drilling tool including one or more pads for steering;

obtaining component data of the BHA and drilling data associated with the drilling; and automatically determining, using the sensor data, the component data, and the drilling data, pad force information for the drilling tool during the drilling, wherein the pad force information includes a leak flowrate associated with a seal of the one or more pads.

2. The method as recited in claim 1, further comprising operating the drilling tool based on the pad force information.

3. The method as recited in claim 1, wherein the pad force information further includes at least one of a maximum pad force, an average pad force, and an expected pad force.

4. The method as recited in claim 1, further comprising storing the pad force information.

5. The method as recited in claim 1, further comprising visually displaying the pad force information.

6. The method as recited in claim 1, wherein the sensor data includes RPM of turbine flowmeter of BHA and differential pressure at the BHA.

7. The method as recited in claim 6, further comprising automatically calibrating a turbine efficiency factor of the turbine flowmeter.

8. The method as recited in claim 1, further comprising automatically identifying steering events related to the pad force information.

9. The method as recited in claim 8, further comprising automatically generating alerts based on the steering events that are identified.

10. The method as recited in claim 8, wherein the automatically identifying uses machine learning to classify the steering events.

11. The method as recited in claim 1, wherein the component data includes geometry information of at least some components of the BHA.

12. The method as recited in claim 1, wherein the drilling data includes mud properties associated with the drilling.

13. The method as recited in claim 1, further comprising automatically changing drilling parameters based on the pad force information.

14. A real-time control and advisory system for drilling, comprising:

one or more processors to perform one or more operations including:

receiving one or more of sensor data from a bottom hole assembly (BHA) in a wellbore during drilling of the wellbore by a drilling tool, component data of the BHA, and drilling data associated with the drilling, wherein the drilling tool includes one or more pads for steering; and determining, during the drilling, pad force information for the drilling tool based on the sensor data, the component data, and the drilling data, wherein the pad force information includes a leak flowrate associated with a seal of the one or more pads.

15. The control and advisory system as recited in claim 14, wherein the one or more operations further include automatically changing drilling parameters for the drilling tool based on the pad force information.

16. The control and advisory system as recited in claim 14, wherein the one or more operations further include providing a visual output of the pad force information.

17. The control and advisory system as recited in claim 14, wherein the one or more operations further include automatically calibrating a turbine efficiency factor of a turbine flowmeter of the BHA.

18. The control and advisory system as recited in claim 14, wherein the one or more operations further include automatically identifying steering events related to the pad force information and automatically generating an alert when at least one steering event is identified.

19. A computer program product having a series of operating instructions stored on a non-transitory computer-readable medium that directs one or more processors when executed thereby to perform operations to direct drilling in a wellbore by a drilling tool including one or more pads for steering, the operations comprising:

obtaining sensor data from a bottom hole assembly (BHA) in a wellbore during the drilling, component data of the BHA, and drilling data associated with the drilling;

determining, during the drilling, pad force information for the drilling tool using the sensor data, the component data, and the drilling data; and automatically changing at least one drilling parameter for the drilling based on the pad force information, wherein the pad force information includes a leak flowrate associated with a seal of the one or more pads.

20. The computer program product as recited in claim 19, wherein the at least one drilling parameter is a steering input for the drilling tool.

* * * * *